United States Patent [19]

Michaelis

[11] 4,087,081

[45] May 2, 1978

[54] PLANT FOR REFINING MOLTEN PIG IRON

[75] Inventor: Eduard Michaelis, Seewalchen, Austria

[73] Assignee: Vereinigte Osterreichische Eisen- und Stahlwerke-Alpine Montan Aktiengesellschaft, Linz, Austria

[21] Appl. No.: 746,235

[22] Filed: Dec. 1, 1976

[30] Foreign Application Priority Data

Sep. 30, 1976 Austria ..... 7243/76

[51] Int. Cl.[2] ..... C21C 5/32; C21C 5/34

[52] U.S. Cl. ..... 266/142; 266/226

[58] Field of Search ..... 75/60; 266/142, 143, 266/158, 225, 226

[56] References Cited

U.S. PATENT DOCUMENTS

| | | | |
|---|---|---|---|
| 2,950,186 | 8/1960 | Allard et al. | 75/60 |
| 3,138,648 | 6/1964 | McFeaters | 266/158 |
| 3,953,199 | 4/1976 | Michaelis | 75/60 |

FOREIGN PATENT DOCUMENTS

| | | | |
|---|---|---|---|
| 220,279 | 2/1925 | United Kingdom | 75/60 |
| 919,875 | 2/1963 | United Kingdom | 266/226 |

*Primary Examiner*—Gerald A. Dost

*Attorney, Agent, or Firm*—Brumbaugh, Graves, Donohue & Raymond

[57] ABSTRACT

A plant for refining molten pig iron has a converter surrounded by a carrying ring which is tiltable about a horizontal axis by oppositely arranged carrying trunnions and at least one water-cooled hook-shaped blowing lance which looks like an inverted U. The lance is liftably and lowerably arranged on a vertically stationary, but horizontally rotatable, vertical lance guide located at a position lateral of the converter and outside its tilting area. At least one lance car guides the water-cooled lance on the vertically stationary lance guide.

4 Claims, 1 Drawing Figure

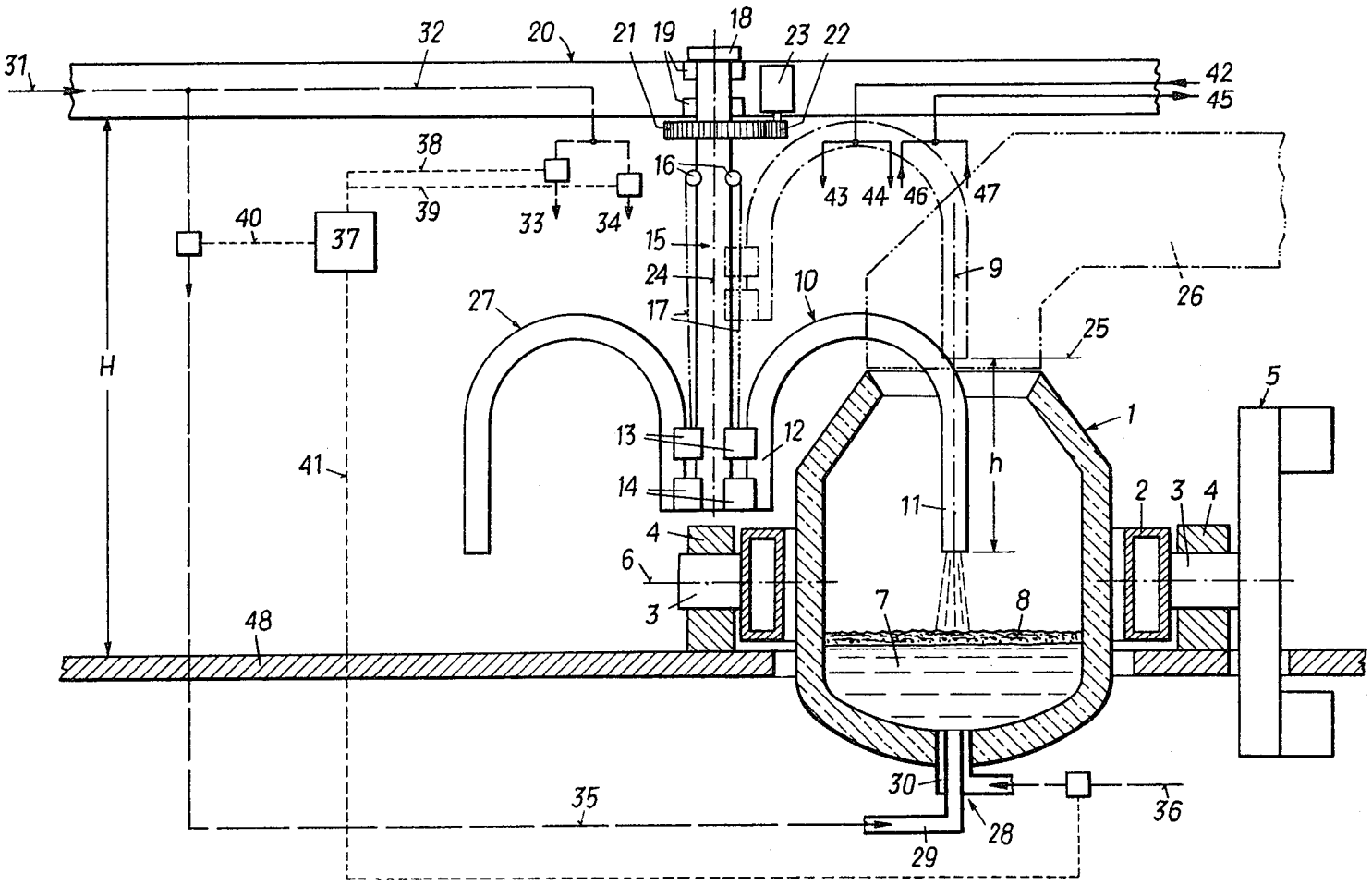
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
h
H

PLANT FOR REFINING MOLTEN PIG IRON

BACKGROUND OF THE INVENTION

The invention relates to a plant for refining molten pig iron with a converter, that is surrounded by a carrying ring and is tiltable about a horizontal axis by means of oppositely arranged carrying trunnions, and with a water-cooled blowing lance, that is liftably and lowerably arranged at a stationary vertical lance guide for supplying oxygen-containing refining gas, preferably technically pure oxygen, and, if desired, finely grained fluxing agents, e.g. lime.

Plants of this kind, in which oxygen is blown from above onto the metal bath, require blowing lances of substantial structural length; in large converter plants this length is more than 20 m. Accordingly, the stationary lance guide arranged at a distance above the converter or above the chimney hood so as to close it during blowing must be constructed very heavily and the converter hall must be very high in this area, which results in substantial investment costs for constructing such steel making plants. The great building height of these so-called LD-steel-making plants is also an obstacle to replacing the open-hearth furnaces still in use with LD converters (top-blowing converters), which are highly productive; i.e. it is difficult to install converter plants having liftable and lowerable oxygen blowing lances into already existing open-hearth furnace steel making plants.

SUMMARY OF THE INVENTION

The invention aims at providing a modern steel making plant by using simple operational means which have already proved successful in practice, whose structural height is as small as possible, and in which the blowing lance means and its accessories are not hampered or damaged by the tilting action of the converter. It is a further object of the invention to provide for the conversion of already existing steel making plants having halls of low height to LD-steel production by using a blowing lance apparatus for the LD-steel-making plants which needs only a little space above the converter mouth.

According to the invention, this object is substantially achieved in that the lance guide is arranged lateral, i.e. to the side, of the converter and outside its pivoting range, preferably in the vertical plane extending through the tilting axis of the converter, and that a hook-shaped blowing lance designed like an inverted U is guided by means of at least one lance car on the lance guide.

Hook-shaped blowing lances are known per se from German Auslegeschrift No. 1,079,086 and Austrian Patent No. 222,676 (corresponding to British patent No. 920,317), but these constructions are not suited for remedying the above described problem. The curved lance described in German Auslegeschrift No. 1,079,086 is introduced through an opening in the upper part of the converter and is directly arranged on the converter in its tilting plane. Thus, it has to follow the tilting movement of the converter and therefore can be damaged easily. Furthermore, the nozzle of this blowing lance is not displaceable in the vertical direction as is absolutely necessary when carrying out the LD-process. The hook-shaped lance described in Austrian patent No. 222,676 is height-adjustable to a slight extent, but it must be moved into the operating position by means of a pivot lever mechanism fastened to the carrying ring in the plane of tilting. Also this construction, due to its relatively complicated structure, has not been used in practice. This apparatus also has the disadvantage that it follows the tilting movement of the converter and thus is subject to disturbances.

According to a further feature of the invention which is suitable for modern LD-converter plants, the column-shaped lance guide is rotatable around its vertical axis and is suspended on a carrier that is part of the structure of the steel making plant. The special advantage of this arrangement resides in the fact that with this construction the structures needed are not very complicated and expensive. One does not need carrying constructions extending lateral of the lance guide and parallel thereto, as is shown e.g. in U.S. Pat. No. 3,083,957. Accordingly, a suspended lance carrier rotatable around its own axis requires only a little space lateral of or between two converters.

According to a further feature of the invention one can choose an arrangement in which the blowing lance is rotatable around a vertical axis extending through the straight leg of the inverted U that is outside the converter. In this case the lance guide itself is not rotatable. However, one can also combine the rotatability of the lance guide around its vertical axis with the rotatability of the blowing lance around the vertical axis of the leg fixed to the lance carrier.

Modern plants have at least two blowing lances and, therefore, it is advantageous that two liftable and lowerable blowing lances having one lifting means each are arranged symmetrical to each other on the lance guide. The symmetrical arrangement of the hook-shaped blowing lances compensates the bending moments which each lance itself exerts on the lance carrier. When the lance carrier is correspondingly strongly built, the two blowing lances can be arranged offset by 90° so that the pivoting movement of the blowing lances can be limited to an angle of 90° . Of course, also four blowing lances, two for the supply of oxygen and lime dust and the other two for the supply of heat by means of gas or oil, can also be secured on such a lance carrier that is suspended on a carrier of the structure of the steel making plant.

If one wants to quickly remove the lance guide from the converter range or to use in a known manner the blowing lances alternately for two converters arranged one beside the other, it is suitable that the lance guide together with the blowing lance and its lifting means be horizontally movable, preferably in the direction of the tilting axis of the converter.

An especially advantageous application of the invention is in a steel making plant, wherein a converter is provided with a liftable and lowerable blowing lance and with nozzles arranged in the bottom of the converter for a simultaneous supply of oxygen and gaseous or liquid hydrocarbons into the metal bath. From the top pure oxygen with lime dust is blown onto the metal bath from the lance, as is described in detail in U.S. Pat. No. 3,953,199. In order to make possible the use of the steel making process described in U.S. Pat. No. 3,953,199 with low investment costs and in order to prevent the structural and operational disadvantages of the usual installations in LD-steel-making plants, an embodiment of the invention combines the following features, namely:

a. that a column-shaped lance guide is arranged above the bearings of the carrying trunnions of the converter at a position lateral of the converter wall and has such a longitudinal extension that the blowing lance can be lifted over the converter mouth;

b. that the blowing lance is pivotable around a vertical axis extending through the vertical plane laid through the tilting axis of the converter;

c. that in the bottom of the converter at least one nozzle, formed by two concentric pipes each, is provided for supplying oxygen and gaseous or liquid hydrocarbons, wherein the oxygen is supplied through the inner pipe and the gaseous or liquid hydrocarbon is supplied through the outer pipe as protection for the oxygen emerging from the nozzle; and d. that a control means is provided for the simultaneous supply and regulation of the pressure and the amount of oxygen to the blowing lance arranged at a distance above the metal bath in the operative position and to the bottom nozzle, wherein the pressure of the oxygen for the bottom nozzle at the beginning of the refining process at first is adjustable to a pressure that prevents pig iron from getting into the bottom nozzle, and then, when a carbon content in the metal bath from between 0.2 and 0.5% by weight has been reached, can be increased to an extent that the circulatory movement and the mixing in the metal bath get stronger.

BRIEF DESCRIPTION OF THE DRAWING

The invention shall now be described in more detail by way of example and with reference to the accompanying drawing which gives a schematical overall view, in which technical details known to the man skilled in the art have been omitted; this drawing shows a front view of a steel making plant partly in section.

DESCRIPTION OF AN EXEMPLARY EMBODIMENT

A converter lined with refractory material is surrounded by a carrying ring 2 and tiltably mounted by means of two carrying trunnions 3 in bearings 4. A slip-on gear necessary for the tilting movement is denoted by 5, and the tilting axis is denoted by 6. The converter 1, in usual manner, is charged with molten pig iron and scrap and refined with pure oxygen from above, a slag layer 8 forming on the metal bath 7. In the vertical axis 9 of the converter, a water-cooled blowing lance 10, which is designed to be hook-like and having the shape of an inverted U, is arranged for centrically and perpendicularly blowing on of oxygen. The axis of the one leg 11 of the inverted U coincides with the vertical axis 9 of the converter, while the other leg 12 is secured by means of two lance cars 13 and 14 to a rigid, vertically stationary lance guide 15 which is independent of the tilting movement of the converter 1. A usual lifting means is provided for the lifting and lowering of the blowing lance 10 for adjusting the desired adjustable distance between the blowing nozzle at the lower end of the straight leg 11 and the metal bath 7. The lifting means comprises a reel 16, driven by an electromotor, for a rope or a chain 17, wherein the reel 16 is directly fastened on the lance guide 15 together with its motor (not shown). The lance guide 15 itself may be designed to be hollow, e.g. a box-type carrier, and in its interior there may be provided either counterweights for the lances, electric conduits or conduits for the supply of water, oxygen, lime dust etc. to the blowing lance. At its upper end the lance guide 15 has a flange-like portion 18 which rests on a bearing 19; a second bearing secured at a distance therebelow to a steel carrier structure 20 has the same reference numeral. Both bearings 19 enable the rotary movement of the lance guide 15 around its vertical axis 24 by means of a toothed wheel 21 rigidly connected to the lance guide 15, which toothed wheel is driven via a pinion 22 by a motor 23 which in turn is secured on the steel carrier structure 20.

The lance guide 15 is suspended on the steel carrier 20 to the side of and at a distance from the converter in the vertical plane extending through the tilting axis 6. The longitudinal extension of the lance guide is so dimensioned that the space for the arrangement of the converter carrying bearings 4 is kept free and the distance between the blowing lance and the converter is as small as possible. With this arrangement the blowing lance 10 need only be lifted by the extent *h*, whereupon — in the position entered in broken lines — a pivoting movement around the vertical axis 24 can be carried out. The length *h* corresponds to the distance of the blowing nozzle, when located above the steel bath 7 in the lowest position of the blowing lance 10, from the converter mouth, taking into consideration a slight safety distance, indicated by line 25. By 26 the contour of a multiple-piece, displaceable chimney hood for removal of the flue gasses from the converter 1 is indicated in broken lines. Such chimney hoods of varying configurations and having apertures or slits for the penetration of the blowing lance 10 at the end of the refining process and at the beginning of the next heat are described, e.g., in previously mentioned U.S. Pat. No. 3,083,957. By 27 a second, symmetrically arranged blowing lance in a reserve position is denoted; it is also moved by a reel 16 via a rope or a chain 17 independent of the lance 10. The converter bottom is penetrated by a bottom blowing device 28. This device is comprised of coaxially arranged pipes 29 and 30 for the supply of oxygen or nitrogen into the metal bath 7. The oxygen therein is blown in under pressure in a known manner through the inner pipe 29 while, as protection for the oxygen jet, gaseous or liquid hydrocarbons are introduced through the outer pipe 30.

For automation of this process a control device 37 for providing a simultaneous supply of oxygen through the blowing lance 10 and the bottom nozzle 28 can be installed. It controls, on the one hand, valves in the oxygen supply conduit 31 and, on the other hand valves in the natural gas supply conduit 36 surrounding the bottom nozzle. Pipe 32 is an oxygen supply conduit leading to the blowing lances 10 and 27 with its connections 33 and 34. The oxygen supply conduit 35 is connected with the inner pipe 29. Corresponding control conduits, entered in broken lines, to the individual pressure and amount regulating valves, the closing devices, the quick closing valves and other safety installations as are customary in LD-steel-making plants are denoted by 38, 39, 40 and 41. Water conduits 42 and 45 with connections 43, 44 and 46, 47 for the supply and removal of the cooling water to the two blowing lances 10 and 27 are analogously depicted. The corresponding flexible tubes for all media, which lead from the stationary connections to the blowing lances, are not shown in order to make the drawing clearer. The same is true for the conduits 35 and 36 for oxygen and natural gas or oil which usually extend through the carrying trunnions 3 and the carrying ring to the bottom nozzle 28. The apparatus for the supply of lime dust or other finely grained materials either through the oxygen conduit 32 or directly to the leg 12 of the blowing lances 10 and 27 are the usual ones, that have been used in LD-steel-making plants for a long time. The plant according to the invention can thus be operated with simple apparatusses and plants which have proven successful in practice in the manner disclosed in U.S. Pat. No. 3,953,199. The distance H between the converter platform 48 and the steel structure 20, which may be, e.g., a craneway carrier, suffices quite easily for accommodating the lance means 10, 27 and 15.

What I claim is:

1. In a plant for refining molten pig iron with a converter surrounded by a carrying ring and tiltable around a horizontal axis by oppositely arranged carrying trunnions supported in bearings and with at least one water-cooled blowing lance that is liftably and lowerably arranged on a vertical lance guide, the improvement comprising:

a stationary carrier structure of the plant located above the level of the converter;

a column-shaped lance guide rotatably suspended from said stationary carrier at a position above the bearings of the carrying trunnions, the vertical axis of said guide being positioned lateral of the converter in a vertical plane extending through its tilting axis, but outside of its tilting range;

at least one lance car attached to said guide so as to rotate with it, said lance car being movable in a vertical direction along said guide;

a hook-shaped configuration for the at least one blowing lance so that it has an inverted U-shape with an upper curved base section and two downwardly extending legs, one leg of the at least one blowing lance being rotatably mounted in said at least one lance car so that it can be lifted from or lowered into the converter mouth, said guide having a length sufficient to enable the lifting of the at least one blowing lance over the converter mouth and;

means for rotating the lance guide around its vertical axis.

2. A plant as set forth in claim 1, wherein two liftable and lowerable blowing lances are provided, each having separate lifting lance cars, the two blowing lances and cars being arranged symmetrical to each other on the lance guide arrangement.

3. A plant as claimed in claim 1 further including:

at least one nozzle formed by an inner pipe and an outer pipe, said inner pipe and said outer pipe being concentric and provided in the bottom of the converter for supplying oxygen and gaseous or liquid hydrocarbons, the oxygen being supplied through said inner pipe and the hydrocarbons being supplied through said outer pipe as protection for the oxygen emerging from said nozzle; and a control means for simultaneously supplying and regulating an amount of oxygen and its pressure, said oxygen being supplied to the at least one blowing lance, which lance is arranged at a distance above the molten pig iron when in an operative position, and to the at least one nozzle provided in the bottom of the converter, the pressure of the oxygen for the nozzle in the bottom of the converter being adjustable at the beginning of the refining process to a pressure which prevents molten pig iron from entering the nozzle in the bottom of the converter and, when a carbon content of between 0.2 and 0.05% by weight has been reached, to an increased pressure such that a circulatory movement and mixing in the molten pig iron being refined is intensified.

4. A plant as claimed in claim 3 wherein the blowing lance supplies oxygen-containing refining gas to the converter, in particular technically pure oxygen and finely-grained fluxing agents, such as lime.

* * * * *

UNITED STATES PATENT OFFICE

CERTIFICATE OF CORRECTION

Patent No. 4,087,081 Dated May 2, 1978

Inventor(s) Eduard Michaelis

It is certified that error appears in the above-identified patent and that said Letters Patent are hereby corrected as shown below:

Col. 3, line 23, "0.5" should read --0.05--;

Col. 3, line 37, after "converter" insert --1--.

Col. 4, line 45, after "hand" insert a comma; and

Col. 4, last line, after "ones" delete the comma.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*